US007835679B2

(12) United States Patent
Baba et al.

(10) Patent No.: US 7,835,679 B2
(45) Date of Patent: Nov. 16, 2010

(54) HEATING DEVICE, FIXING DEVICE, AND IMAGE FORMING DEVICE

(75) Inventors: Motofumi Baba, Kanagawa (JP); Hiroshi Tamemasa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 241 days.

(21) Appl. No.: 11/882,695

(22) Filed: Aug. 3, 2007

(65) Prior Publication Data

US 2008/0205948 A1 Aug. 28, 2008

(30) Foreign Application Priority Data

Feb. 23, 2007 (JP) ..... 2007-043931

(51) Int. Cl.
*G03G 15/20* (2006.01)

(52) U.S. Cl. ..... 399/329; 399/333; 219/216

(58) Field of Classification Search ..... 399/328, 399/333, 330, 331
See application file for complete search history.

(56) References Cited

U.S. PATENT DOCUMENTS

| | | | | |
|---|---|---|---|---|
| 6,795,679 | B2 * | 9/2004 | Shimizu et al. | 399/333 |
| 7,006,781 | B2 * | 2/2006 | Imai et al. | 399/333 |
| 2005/0047839 | A1 * | 3/2005 | Shimizu et al. | 399/333 |

FOREIGN PATENT DOCUMENTS

| | | |
|---|---|---|
| JP | 2003-223063 | 8/2003 |
| JP | 2003-233260 | 8/2003 |

* cited by examiner

*Primary Examiner*—David M Gray
*Assistant Examiner*—G. M. Hyder
(74) *Attorney, Agent, or Firm*—Morgan, Lewis & Bockius LLP

(57) ABSTRACT

A heating device has a magnetic field generating unit generating a magnetic field, a heat generating layer, and a heating/rotating unit. The heat generating layer is disposed so as to oppose the magnetic field generating unit, and is at least electromagnetically induced by the magnetic field to generate heat. The heating/rotating unit includes a supporting layer which supports the heat generating layer, and has n (n≧2) metal layers.

12 Claims, 8 Drawing Sheets

HEATING DEVICE, FIXING DEVICE, AND IMAGE FORMING DEVICE

CROSS-REFERENCE TO RELATED APPLICATION

This application is based on and claims priority under 35 USC 119 from Japanese Patent Application No. 2007-043931 filed Feb. 23, 2007.

BACKGROUND

1. Technical Field

The present invention relates to a heating device, a fixing device, and an image forming device.

2. Related Art

Conventionally, an image forming device, such as a printer, a copier, or the like which carries out image formation by using an electrophotographic method, uses a fixing device which passes a toner image, which has been transferred on a recording sheet, through a nip portion formed by a pressure-applying roller and a fixing roller or a fixing belt which has a heat source such as a halogen heater or the like, and fuses and fixes the toner by the working of the heat and the pressure.

The thinner the heat transfer layer of the fixing belt or fixing roller, the better the heat transfer characteristic thereof, and the more effective in shortening the start-up time of the fixing device.

SUMMARY

According to an aspect of the invention, a heating device includes a magnetic field generating unit and a heating/rotating unit. The magnetic field generating unit generates a magnetic field. The heating/rotating unit is disposed so as to oppose the magnetic field generating unit. Furthermore, the heating/rotating unit has n ($n \geqq 2$) metal layers which satisfy the following conditions (a), (b), (c) and include at least a heat generating layer, which is electromagnetically induced by the magnetic field to generate heat, and a supporting layer which supports the heat generating layer:

(a) a total thickness t of the metal layers is greater than or equal to 30 μm and less than or equal to 200 μm;

(b) the following formula (1) and formula (2) are satisfied:

$$\text{the total thickness } t \text{ of metal layers} < \delta 1+\delta 2+\delta 3+\ldots+\delta n \qquad \text{formula (1)}$$

$$\text{thickness tn of nth metal layer} < \delta n \qquad \text{formula (2)}$$

where δ is a surface skin depth of metal, surface skin depths δ1, δ2, δ3, . . . , δn of a first layer, a second layer, a third layer, . . . , an nth layer are $\delta 1=503\sqrt{(\rho 1/f\times\mu 1)}$, $\delta 2=503\sqrt{(\rho 2/f\times\mu 2)}$, $\delta 3=503\sqrt{(\rho 3/f\times\mu 3)}$, $\delta n=503\sqrt{(\rho n/f\times\mu n)}$, ρn is a specific resistance of each metal layer, f is a frequency of a signal at the magnetic field generating unit, and μn is a relative permeability at room temperature of each metal layer; and (c) the following formula (3) is satisfied:

$$1/R \leqq 1/R1+1/R2+1/R3+\ldots+1/Rn \qquad \text{formula (3)}$$

where R is the ratio of specific resistance value to thickness, and R1=ρ1/t1, R2=ρ2/t2, R3=ρ3/t3, and Rn=ρn/tn.

BRIEF DESCRIPTION OF THE DRAWINGS

Exemplary embodiments of the present invention will be described in detail based on the following figures wherein.

DETAILED DESCRIPTION

A first exemplary embodiment of a heating device, a fixing device, and an image forming device will be described hereinafter on the basis of the drawings.

Figure 1:
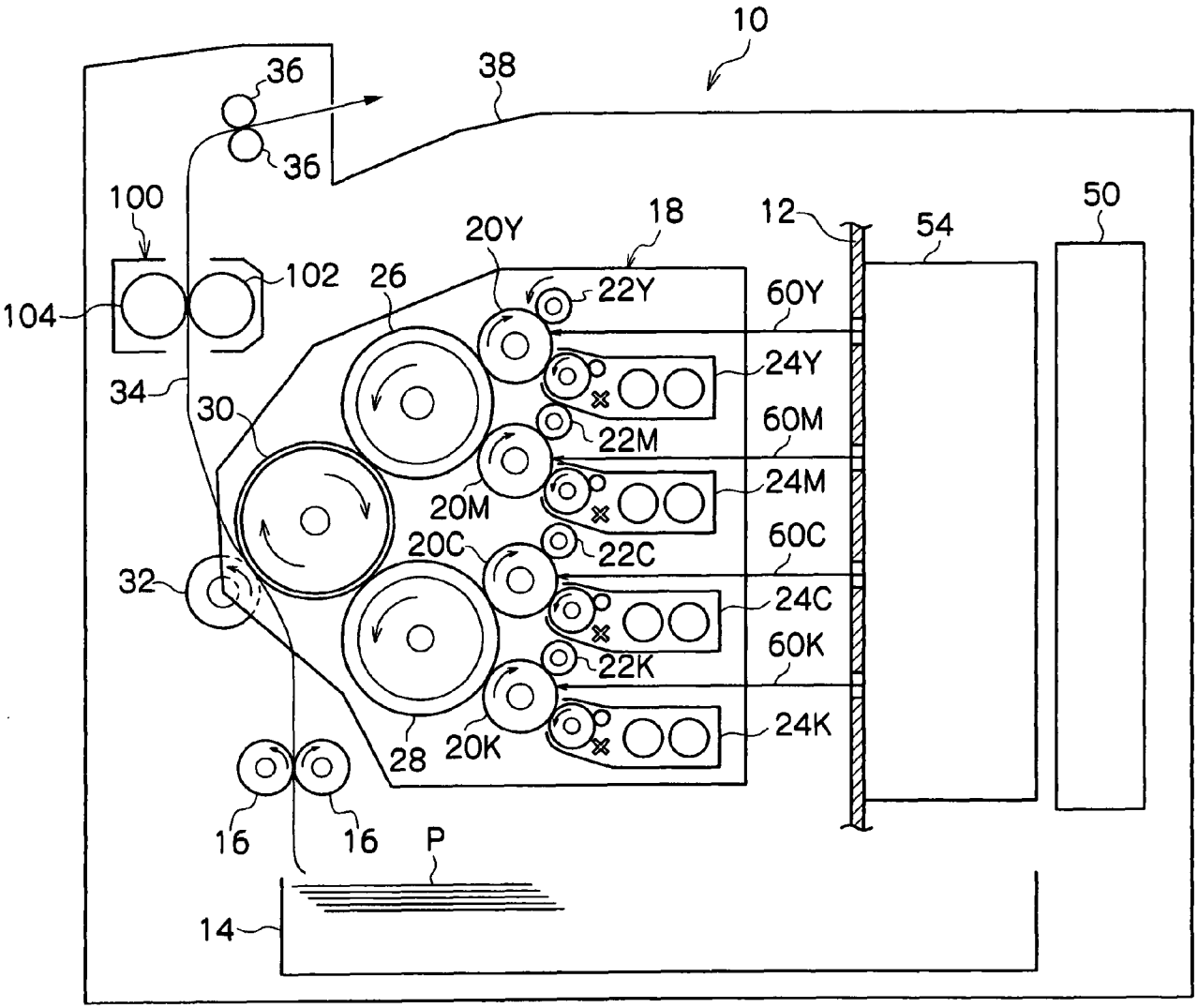
FIG. 1 is an overall view of an image forming device relating to a first exemplary embodiment.

A printer 10 serving as an image forming device is shown in FIG. 1.

At the printer 10, a light scanning device 54 is fixed to a housing 12 which is the main body of the printer 10. A control unit 50, which controls the operations of the respective portions of the light scanning device 54 and the printer 10, is provided at a position adjacent to the light scanning device 54.

The light scanning device 54 scans, by a rotating polygon mirror, light beams exiting from unillustrated light sources, and reflects the light beams at plural optical parts such as reflecting mirrors and the like, and emits light beams 60Y, 60M, 60C, 60K corresponding to respective toners of yellow (Y), magenta (M), cyan (C), and black (K).

The light beams 60Y, 60M, 60C, 60K are guided to photosensitive bodies 20Y, 20M, 20C, 20K corresponding respectively thereto.

A sheet tray 14 which accommodates recording sheets P is provided at the lower side of the printer 10. A pair of resist rollers 16, which adjust the position of the distal end portion of the recording sheet P, is provided above the sheet feed tray 14.

An image forming unit 18 is provided at the central portion of the printer 10. The image forming unit 18 has the aforementioned four photosensitive bodies 20Y, 20M, 20C, 20K, and these are lined-up in a row in the vertical direction.

Charging rollers 22Y, 22M, 22C, 22K, which charge the surfaces of the photosensitive bodies 20Y, 20M, 20C, 20K, are provided at the upstream sides in the directions of rotation of the photosensitive bodies 20Y, 20M, 20C, 20K.

Developing devices 24Y, 24M, 24C, 24K, which develop the toners of Y, M, C, K on the photosensitive bodies 20Y, 20M, 20C, 20K respectively, are provided at the downstream sides in the directions of rotation of the photosensitive bodies 20Y, 20M, 20C, 20K.

On the other hand, a first intermediate transfer body 26 contacts the photosensitive bodies 20Y, 20M, and a second intermediate transfer body 28 contacts the photosensitive bodies 20C, 20K. A third intermediate transfer body 30 contacts the first intermediate transfer body 26 and the second intermediate transfer body 28.

A transfer roller 32 is provided at a position opposing the third intermediate transfer body 30. The recording sheet P is conveyed between the transfer roller 32 and the third intermediate transfer body 30, and the toner image on the third intermediate transfer body 30 is transferred onto the recording sheet P.

A fixing device 100 is provided downstream of a sheet conveying path 34 at which the recording sheet P is conveyed. The fixing device 100 has a fixing belt 102 and a pressure-applying roller 104, and heats and applies pressure to the recording sheet P so as to fix the toner image on the recording sheet P.

The recording sheet P on which the toner image has been fixed is discharged-out by sheet conveying rollers 36 to a tray 38 which is provided at the top portion of the printer 10.

The image formation of the printer 10 will be described next.

When image formation starts, the surfaces of the respective photosensitive bodies 20Y through 20K are charged uniformly by the charging rollers 22Y through 22K.

The light beams 60Y through 60K which correspond to the output image are illuminated from the light scanning device 54 onto the surfaces of the charged photosensitive bodies 20Y through 20K, such that electrostatic latent images corresponding to respective color-separated images are formed on the photosensitive bodies 20Y through 20K.

The developing devices 24Y through 24K selectively furnish toners of the respective colors, i.e., Y through K, to the electrostatic latent images, and toner images of the colors Y through K are formed on the photosensitive bodies 20Y through 20K.

Thereafter, the magenta toner image is primarily transferred from the photosensitive body 20M for magenta onto the first intermediate transfer body 26. Further, the yellow toner image is primarily transferred from the photosensitive body 20Y for yellow onto the first intermediate transfer body 26, and is superposed on the magenta toner image on the first intermediate transfer body 26.

On the other hand, similarly, the black toner image is primarily transferred from the photosensitive body 20K for black onto the second intermediate transfer body 28. Further, the cyan toner image is primarily transferred from the photosensitive body 20C for cyan onto the second intermediate transfer body 28, and is superposed on the black toner image on the second intermediate transfer body 28.

The toner images of magenta and yellow, which have been primarily transferred onto the first intermediate transfer body 26, are secondarily transferred onto the third intermediate transfer body 30. On the other hand, the black and cyan toner images, which have been primarily transferred onto the second intermediate transfer body 28, as well are secondarily transferred onto the third intermediate transfer body 30.

The magenta and yellow toner images, which are secondarily transferred first, and the cyan and black toner images are superposed one on another here, and a full-color toner image of colors (three colors) and black is formed on the third intermediate transfer body 30.

The full color toner image which has been secondarily transferred reaches the nip portion between the third intermediate transfer body 30 and the transfer roller 32. Synchronously with the timing thereof, the recording sheet P is conveyed from the resist rollers 16 to the nip portion, and the full color toner image is tertiarily transferred onto the recording sheet P (final transfer).

Thereafter, this recording sheet P is sent to the fixing device 100, and passes through the nip portion of the fixing belt 102 and the pressure-applying roller 104. At this time, the full color toner image is fixed to the recording sheet P due to the working of the heat and pressure which are applied from the fixing belt 102 and the pressure-applying roller 104. After fixing, the recording sheet P is discharged-out to the tray 38 from the sheet conveying rollers 36, and the formation of a full color image on the recording sheet P is completed.

The fixing device 100 relating to the present exemplary embodiment will be described next.

Figure 2:
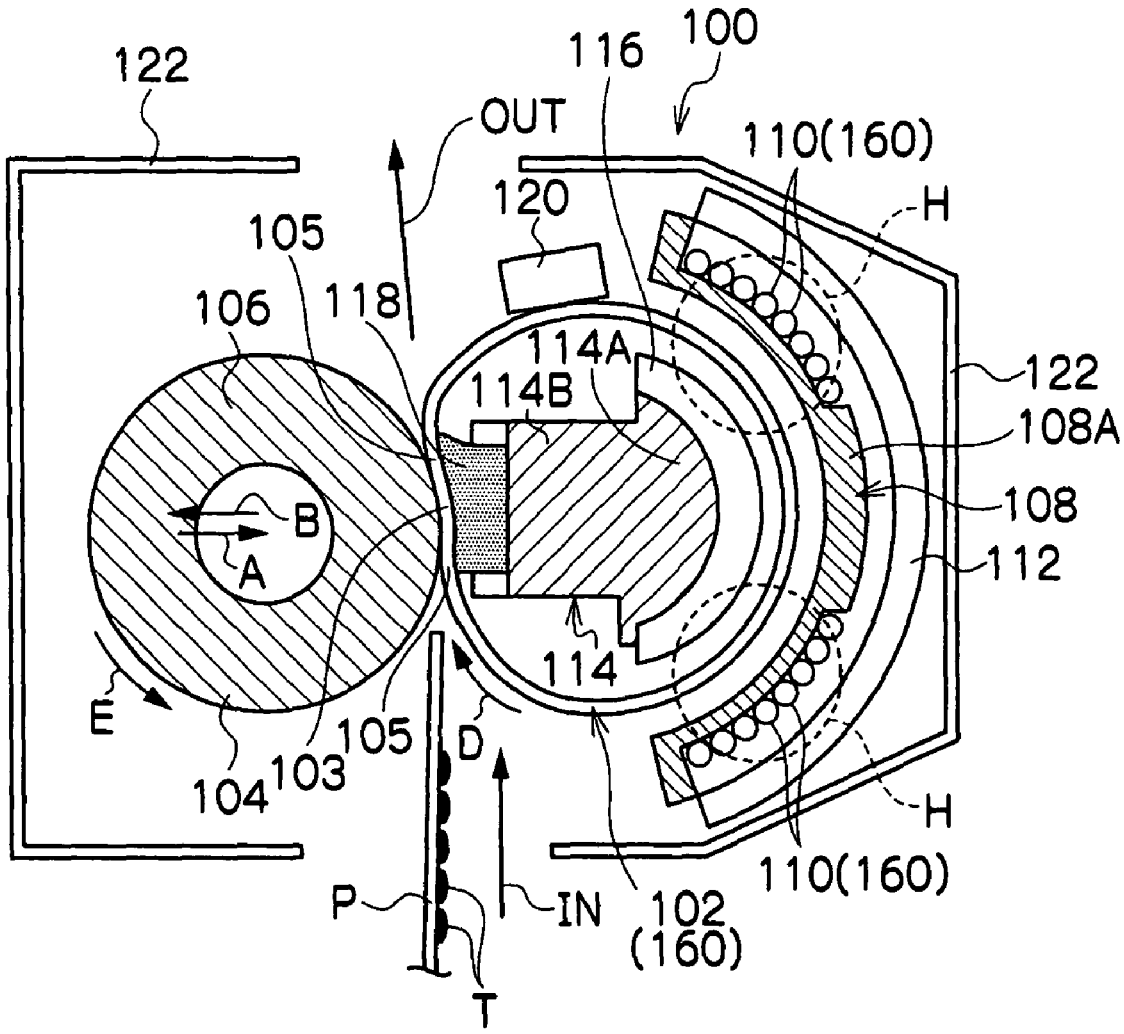
FIG. 2 is a cross-sectional view of a fixing device relating to the first exemplary embodiment.

As shown in FIG. 2, the fixing device 100 has a housing 122 in which are formed openings for the entry and discharging of the recording sheet P.

The fixing belt 102, which is endless and rotates in the direction of arrow D, is provided in the housing 122.

A bobbin 108 formed of an insulating material is disposed at a position opposing the outer peripheral surface of the fixing belt 102. The interval between the bobbin 108 and the fixing belt 102 is about 1 to 3 mm. The bobbin 108 is formed in a substantial arc shape which follows the outer peripheral surface of the fixing belt 102. A convex portion 108A projects-out from the bobbin 108.

A excitation coil 110 is wound plural times in the axial direction (the direction perpendicular to the surface of the drawing of FIG. 2) at the bobbin 108, with the convex portion 108A being the center.

A heating device 160 is configured by the fixing belt 102 and the excitation coil 110.

A magnetic core 112, which is formed of a ferrite magnetic body and is formed in a substantial arc shape which follows the arc shape of the bobbin 108, is disposed at a position opposing the excitation coil 110, and is supported at the bobbin 108.

On the other hand, a supporting unit 114, which is formed from aluminum and is a non-magnetic body, is disposed at the inner side of the fixing belt 102 so as to not contact the fixing belt 102. Both ends of the supporting unit 114 are fixed to the housing 122 of the fixing device 100.

The supporting unit 114 is configured by an arc-shaped portion 114A which is formed in the shape of an arc and opposes the fixing belt 102, and a column portion 114B which is formed in the shape of a column. The arc-shaped portion 114A and the column portion 114B are molded integrally.

A magnetic core 116, which is formed from a similar material as the aforementioned magnetic core 112, is provided at the arc-shaped portion 114A of the supporting unit 114, along the arc-shaped portion 114A. The magnetic core 116 is in a state of non-contact with the fixing belt 102. A closed magnetic path due to a magnetic field H which passes through the fixing belt 102 is formed between the magnetic core 116 and the magnetic core 112, and the magnetic field H is strengthened.

A pushing unit 118, which is for pushing the fixing belt 102 toward the outer side at a predetermined pressure, is fixed to an end surface of the column portion 114B of the supporting unit 114.

The pushing unit 118 is formed by a unit which is elastic, such as urethane rubber, sponge, or the like. One end surface of the pushing unit 118 contacts the inner peripheral surface of the fixing belt 102 and pushes the fixing belt 102 outwardly.

On the other hand, the pressure-applying roller 104 is disposed at a position opposing the outer peripheral surface of the fixing belt 102. The pressure-applying roller 104 applies pressure to the fixing belt 102 toward the pushing unit 118, and rotates in the direction of arrow E by a driving mechanism formed from an unillustrated motor and gears.

The pressure-applying roller 104 is configured such that the periphery of a core metal 106, which is formed from a metal such as aluminum or the like, is covered by silicon rubber or PFA (tetrafluoroethylene-perfluoroalkoxyethylene copolymer resin). Further, the pressure-applying roller 104 can move in the directions of arrows A and B by using a cam mechanism or an electromagnetic switch such as a solenoid or the like (none of which is illustrated). When the pressure-applying roller 104 moves in the direction of arrow A, it contacts and applies pressure to the outer peripheral surface of the fixing belt 102. When the pressure-applying roller 104 moves in the direction of arrow B, it moves apart from the outer peripheral surface of the fixing belt 102.

Here, when the pressure-applying roller 104 applies pressure to the fixing belt 102 toward the pushing unit 118, at the contact portion (the nip portion) of the fixing belt 102 and the pressure-applying roller 104, a concave portion 103 is formed by the fixing belt 102 and convex portions 105 are formed by the pressure-applying roller 104.

The shape of this nip portion is a shape which is curved in a direction of causing the recording sheet P to peel away from the fixing belt 102 when the recording sheet P carrying the toner T passes through. Therefore, the recording sheet P, which is conveyed-in from the direction of arrow IN, follows the shape of the nip portion due to the stiffness of the recording sheet P, and is discharged in the direction of arrow OUT.

The pushing unit 118 pushes the fixing belt 102 toward the pressure-applying roller 104, and curves so as to follow the inner peripheral surface of the fixing belt 102, and widens the nip width.

A thermistor 120, which measures the temperature of the surface of the fixing belt 102, is provided so as to contact a region at the surface of the fixing belt 102 which region does not oppose the excitation coil 110 and is at the discharging side of the recording sheet P. The position of contact of the thermistor 120 is a substantially central portion in the axial direction of the fixing belt (the direction perpendicular to the surface of the drawing of FIG. 2), such that the measured value thereof does not change in accordance with the magnitude of the size of the recording sheet P.

The thermistor 120 measures the temperature of the surface of the fixing belt 102 due to the resistance value varying in accordance with the amount of heat provided from the surface of the fixing belt 102.

Figure 4:
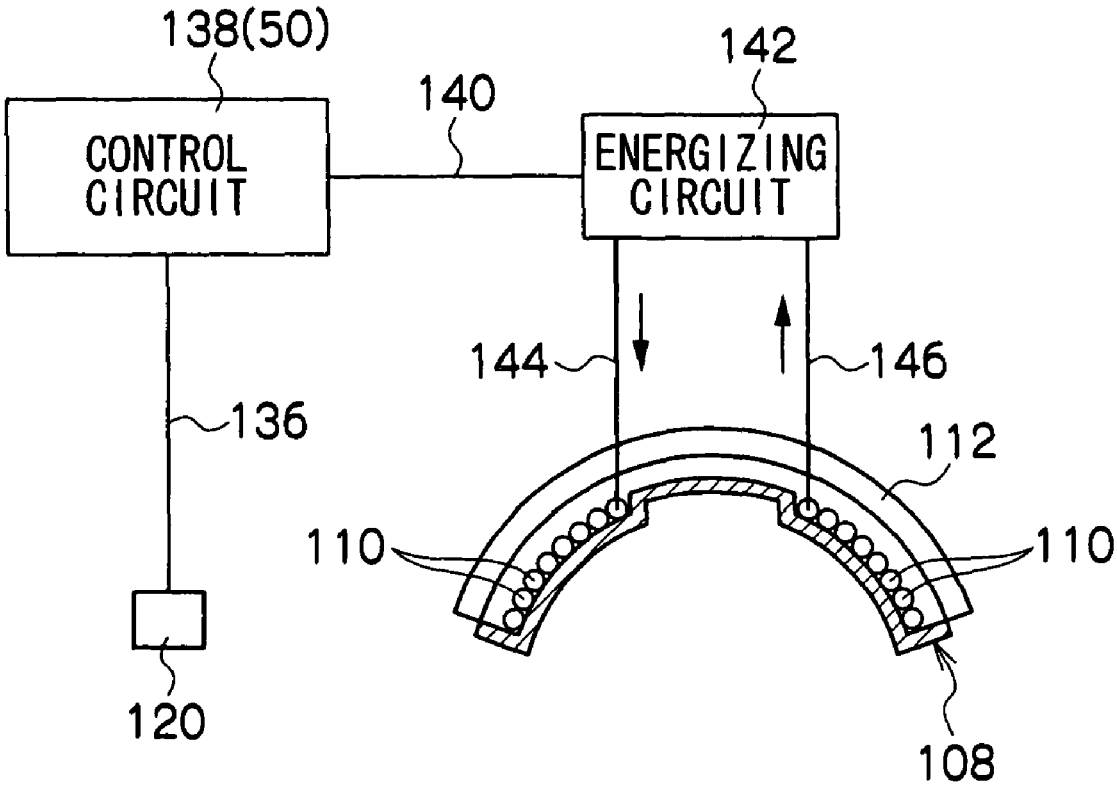
FIG. 4 is a connection diagram of a control circuit and an energizing circuit relating to the first exemplary embodiment.

As shown in FIG. 4, the thermistor 120 is connected, via a wire 136, to a control circuit 138 provided at the interior of the aforementioned control unit 50 (see FIG. 1). The control circuit 138 is connected to an energizing circuit 142 via a wire 140. The energizing circuit 142 is connected to the aforementioned excitation coil 110 via wires 144, 146.

Here, on the basis of an electrical amount sent from the thermistor 120, the control circuit 138 measures the temperature of the surface of the fixing belt 102, and compares this measured temperature and a set fixing temperature which is stored in advance (170° C. in the present exemplary embodiment). If the measured temperature is lower than the set fixing temperature, the control circuit 138 drives the energizing circuit 142 and energizes the excitation coil 110, and causes the magnetic field H (see FIG. 2) serving as a magnetic circuit to be generated. On the other hand, if the measured temperature is higher than the set fixing temperature, the control circuit 138 stops the energizing circuit 142.

The energizing circuit 142 is driven or the driving thereof is stopped on the basis of an electric signal sent from the control circuit 138. The energizing circuit 142 supplies or stops the supply of alternating current of a predetermined frequency to the excitation coil 110 via the wires 144, 146.

The structure of the fixing belt 102 will be described next.

Figure 3A:
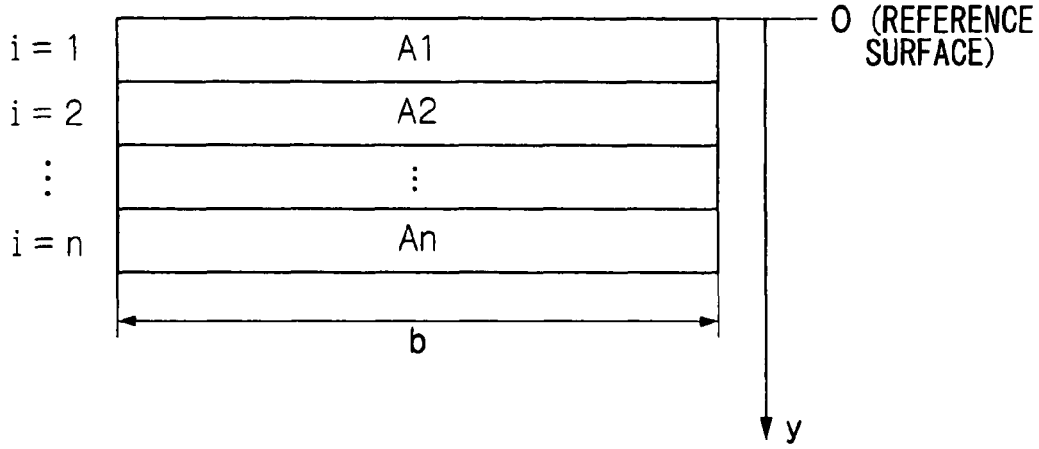
FIG. 3A is a schematic drawing showing a layered state of a fixing belt relating to the first exemplary embodiment.
Figure 3B:
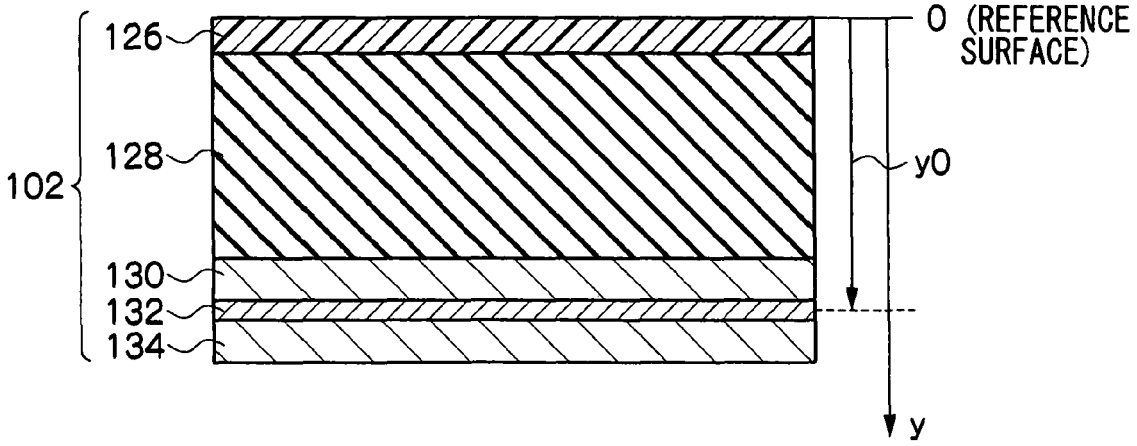
FIG. 3B is a cross-sectional view of the fixing belt relating to the first exemplary embodiment.

As shown in FIG. 3B, the fixing belt 102 is configured by a base layer 134, a heat generating layer 132, a protective layer 130, an elastic layer 128, and a releasing layer 126 from the inner side toward the outer side thereof. These layers are laminated together and made integral.

The base layer 134 is the base which maintains the strength of the fixing belt 102, and is structured of non-magnetic stainless steel (non-magnetic SUS).

The heat generating layer 132 is a metal material which generates heat due to the working of electromagnetic induction in which eddy current flows in order to generate a magnetic field which cancels the aforementioned magnetic field H (see FIG. 2). For example, gold, silver, copper, aluminum, zinc, tin, lead, bismuth, beryllium, antimony, or a metal material which is an alloy thereof can be used. In the present exemplary embodiment, copper is used as the heat generating layer 132 in order to make the specific resistance be low at less than or equal to $2.7\times10^{-8}$ Ωcm and efficiently obtain the needed generated heat amount, and also from the standpoint of low cost.

Making the thermal capacity of the heat generating layer 132 as small as possible can shorten the warm-up time of the fixing device 100. Therefore, it is desirable to provide as thin a layer as possible as the heat generating layer 132. If the heat generating layer 132 is the aforementioned non-magnetic metal, heating can be carried out by a layer having a thickness of 2 μm to 20 μm.

Figure 7:
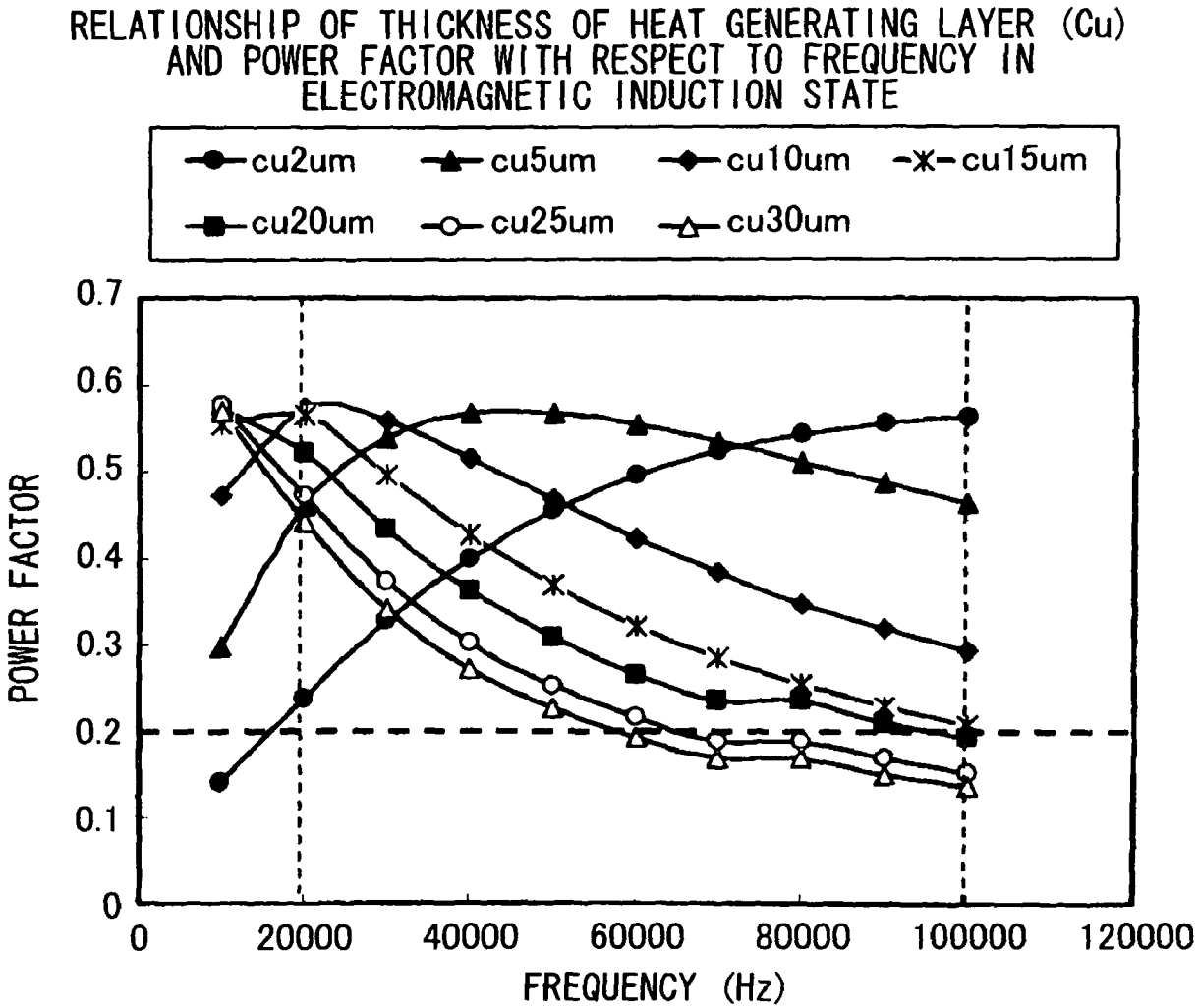
FIG. 7 is a graph of power factor with respect to frequency when the thickness of a heat generating layer of the fixing belt relating to the first exemplary embodiment is varied.

Here, when the power factor with respect to the frequency (20 kHz to 100 kHz) of the current which the energizing circuit 142 passes in the electromagnetic induction state, was tested by varying the thickness of the heat generating layer 132 (copper) and keeping the conditions of the other layers fixed, the graph of FIG. 7 was obtained.

Note that the power factor is an index expressing the heat generating efficiency which is determined by power factor=P/(i×V), where the electric power actually consumed by the heat generating layer 132 is effective electric power P, and the current value passed by the energizing circuit 142 is i, and the voltage value is V. If the power factor is low, the current and the voltage amount which are needed in order to obtain the same effective electric power P need to be increased.

As shown in FIG. 7, when the thickness of the heat generating layer 132 is greater than or equal to 25 μm, the apparent resistance of the eddy current is low, the eddy current loss is small, and the power factor (heat generating efficiency) at frequencies of greater than or equal to 60 kHz is less than 0.2.

Here, an element which makes the current voltage of 50 Hz or 60 Hz at the power source unit a high frequency (e.g., greater than or equal to 20 kHz) is needed in order to carry out electromagnetic induction heating. However, when the power factor is low, there is the problem that, in order to the increase the current voltage, the generated heat amount of the element increases and the loss at the power source unit (power loss) increases. Therefore, evaluation of the power loss was carried out by varying the power factor.

The results of evaluation of the power loss are shown in Table 1. Note that, in Table 1, O shows a state in which the power loss is less than 10%, Δ shows a state in which the power loss is greater than or equal to 10%, and X shows a state in which the heat generation of the element is great and continuous energization is difficult.

TABLE 1

| power factor | evaluation of power source |
|---|---|
| 0.40 | ○ |
| 0.35 | ○ |
| 0.30 | ○ |
| 0.25 | ○ |
| 0.20 | Δ |
| 0.15 | X |
| 0.10 | X |

As shown in Table 1, it is preferable that the power factor is greater than or equal to 0.2. Note that, in the graph of FIG. 7, the power factor being greater than or equal to 0.2 is cases in which the thickness of the heat generating layer 132 is less than or equal to 20 μm.

From the results of these studies, it is preferable that the thickness of the heat generating layer 132 is greater than or equal to 2 μm and less than or equal to 20 μm. In the present exemplary embodiment, the thickness of the heat generating layer 132 is 10 μm.

On the other hand, in FIG. 3B, the thickness and the material of the protective layer 130 are determined while taking into consideration the rigidity of the fixing belt 102 and the thickness of the heat generating layer 132. Further, the protective layer 130 at the excitation coil 110 side needs to make the magnetic field H (see FIG. 2) from the excitation coil 110 work on the heat generating layer 132, and it is required of the protective layer 130 that the magnetic field H not be cut-off at the protective layer 130 and that the protective layer 130 not impede the heat generating efficiency of the heat generating layer 132. To this end, the thickness and the material of the protective layer 130 are studied.

First, with regard to rigidity, a seamless tube made of stainless steel having a high mechanical strength was used, and pressing force substantially equal to that of the nip portion of the fixing belt 102 and the pressure-applying roller 104 was applied thereto, and it was confirmed whether or not the seamless tube flexed inwardly within an elastic deformation region. As a result, it was confirmed that, when the thickness of the seamless tube was 250 μm, the seamless tube did not flex within the elastic deformation region, and, at 200 μm, the seamless tube started to flex within the elastic deformation region, and at 150, 125, 100, and 75 μm, the seamless tube flexed sufficiently within the elastic deformation region. In this way, it was learned that the layer thickness of the metal layers overall, including the base layer 134, the heat generating layer 132 and the protective layer 130, need to be less than or equal to 200 μm, and there is sufficient flexibility when the layer thickness is less than 200 μm. Further, it was learned that the thicknesses of the base layer 134 and the protective layer 130 which sandwich the heat generating layer 132 need to each be less than or equal to 100 μm.

Note that it is preferable that the total thickness of the metal layers overall is greater than or equal to 30 μm, from the standpoints of maintaining the accuracy of the film thicknesses at the time of manufacturing the fixing belt 102 and maintaining the thermal capacity in order to suppress a drop in temperature.

At the protective layer 130 whose thickness is less than or equal to 100 μm, in order for the magnetic flux of the magnetic field H to penetrate to the heat generating layer 132, the surface skin depth which expresses the depth which the magnetic field can penetrate (the distance over which the magnetic field is damped by 1/e, where e is approximately 2.718) needs to be at least a thickness which is greater than or equal to the total of the thickness of the protective layer 130 and the thickness of the heat generating layer 132. Non-magnetic metals (paramagnetic bodies whose relative permeability is approximately 1) are examples of materials whose surface skin depth is a sufficiently large value.

Further, a material of a high specific resistance at which it is generally difficult for heat to be generated can be used in order for the protective layer 130 to not impede the heat generation of the heat generating layer 132 (ideally, a metal whose relative permeability=1 and whose specific resistance=∞).

Here, when the fixing belt 102, at which all of the three layers of the protective layer 130, the heat generating layer 132, and the base layer 134 are formed of non-magnetic bodies and through which the magnetic flux of the magnetic field H passes, is used at the fixing device 100, the eddy current generated by electromagnetic induction can be controlled from either of the inner side or the outer side of the fixing belt, and the excitation coil 110 can be disposed at either of the inner side or the outer side of the fixing belt 102. In this way, there is the advantage that the designing of the layout of the fixing device 100 is facilitated.

Further, materials, whose mechanical strength is higher than that of the heat generating layer 132 and which are resistant to repeated strain and which are resistant to rust and corrosion, can be used for the base layer 134 and the protective layer 130.

As a result of these studies, the protective layer 130 was structured of non-magnetic stainless steel (specific resistance=60 to $80\times10^{-8}$ Ωm), and the thickness of the protective layer 130 and the base layer 134 was made to be 30 μm each. Further, the base layer 134, the heat generating layer 132, and the protective layer 130 were molded integrally and a seamless tube formed of clad steel was formed.

From the standpoint of obtaining excellent elasticity and heat resistance, and the like, a silicon rubber or a fluorine rubber is used as the elastic layer 128. In the present exemplary embodiment, silicon rubber is used. The thickness of the elastic layer 128 in the present exemplary embodiment is 200 μm.

The releasing layer 126 is provided in order to weaken the adhesive force with the toner T (see FIG. 2) which is fused on the recording sheet P, and make the recording sheet P peel-away easily from the fixing belt 102. In order to obtain excellent surface releasability, it suffices to use a fluorine resin, silicon resin, or polyimide resin as the releasing layer 126. PFA (tetrafluoroethylene-perfluoroalkoxyethylene copolymer resin) is used in the present exemplary embodiment. Note that the thickness of the releasing layer 126 in the present exemplary embodiment is 30 μm.

The total thickness t of the metal layers which include the base layer 134, the heat generating layer 132, and the protective layer 130 will be described next.

First, a thickness through which the magnetic field H can penetrate (surface skin depth) δn is expressed by following formula (1), where the specific resistance of the nth layer of the metal layers is ρn, the relative permeability is μn, and the frequency of the signal (current) at the excitation coil 110 is f.

$$\delta_n = 503\sqrt{\frac{\rho_n}{f\cdot\mu_n}} \qquad \text{formula (1)}$$

Given that the protective layer 130 is a first layer, the heat generating layer 132 is a second layer, and the base layer 134 is a third layer, because the protective layer 130 and the base layer 134 are formed of non-magnetic stainless steel and the relative permeability thereof can be at approximately 1 as described above, specific resistance $\rho 1=\rho 3=60\times10^{-8}$ Ωm, and relative permeability $\mu 1=\mu 3=1$.

Given that the frequency of the signal (current) at the excitation coil 110 is f=20 kHz, in accordance with formula (1), $\delta 1=\delta 3\approx 2755$ μm.

On the other hand, the heat generating layer 132 is copper, and given that the specific resistance $\rho 2=1.7\times10^{-8}$ Ωm and the relative permeability=1, in accordance with formula 1, $\delta 2\approx 464$ μm.

As described above, a thickness (t1) of the protective layer 130 and a thickness (t3) of the base layer 134 are t1=t3=30 μm, and a thickness (t2) of the heat generating layer 132 is t2=10 μm. Therefore, following formula (2) is established.

$$t_1<\delta_1, t_2<\delta_2, t_3<\delta_3 \qquad \text{formula (2)}$$

Further, with regard to the total thickness t of the metal layers and the total of the surface skin depths, following formula (3) is established.

$$t=(t_1+t_2+t_3)<(\delta_1+\delta_2+\delta_3) \qquad \text{formula (3)}$$

Due to formula (2) and formula (3) being established, the magnetic flux of the magnetic field H passes-through the protective layer 130, the heat generating layer 132, and the base layer 134.

Note that the metal layers are not only the above-described three-layer structure of the protective layer 130, the heat generating layer 132 and the base layer 134, and may be metal layers which include at least the heat generating layer 132 and the base layer 134 and are formed of n layers (n≧2).

Figure 6A:
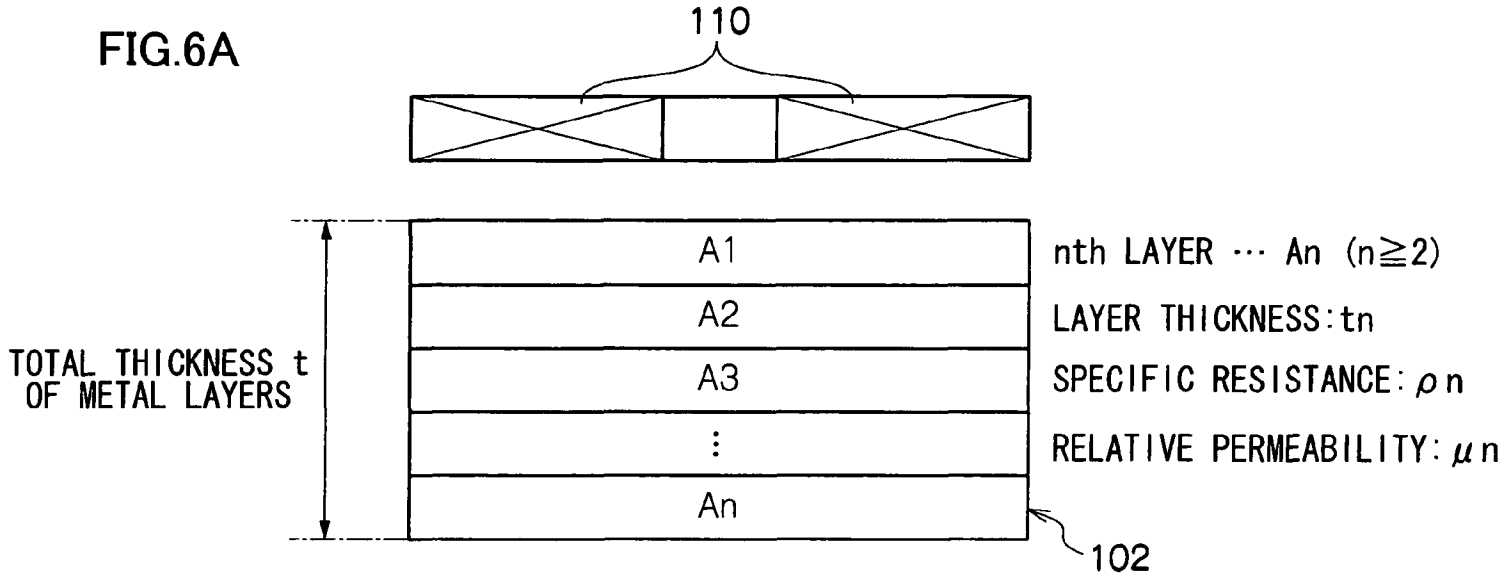
FIG. 6A is a schematic drawing showing a layered state of metal layers of the fixing belt relating to the first exemplary embodiment.

As shown in FIG. 6A, the metal layers of the fixing belt 102 are formed from n metal layers, and are, from the side near the excitation coil 110, a first layer (A1), a second layer (A2), a third layer (A3), . . . , an nth layer (An), and, for each layer, the layer thickness is tn, the specific resistance is ρn, and the relative permeability is μn.

In this case, it suffices for the conditions for the magnetic flux of the magnetic field H to pass-through all of the metal layers satisfy formula (4) and formula (5), in addition to above formula (1).

$$t_1<\delta_1, t_2<\delta_2, t_3<\delta_3, \ldots, t_n<\delta_n \qquad \text{formula (4)}$$

$$t=(t_1+t_2+t_3+\ldots+t_n)<(\delta_1+\delta_2+\delta_3+\ldots+\delta_n) \qquad \text{formula (5)}$$

The total specific resistance ρ and the total thickness t of the metal layers will be described next.

Figure 6B:
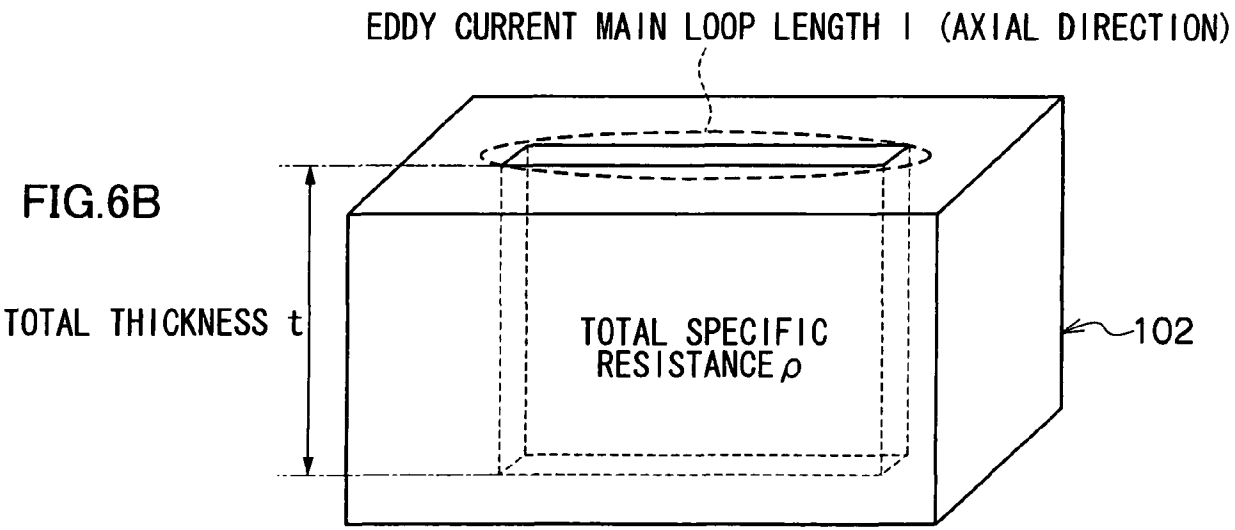
FIG. 6B is a schematic drawing showing eddy current main loop length and total specific resistance of the metal layers of the fixing belt relating to the first exemplary embodiment.

As shown in FIG. 6B, given that the total specific resistance of the metal layers is ρ, the total thickness is t, the main loop length (the axial direction of the fixing belt 102) of the eddy current generated by the magnetic field H is I, the cross-sectional area through which I flows is A, and the cross-section conversion coefficient which becomes K=A/t is K, the total resistance Ra of the region through which the eddy current flows is Ra=(ρ×I)/(t×K). Further, the resistance Ran of the nth layer is Ran=(ρn×I)/(tn×K).

Here, given that the protective layer 130 of the metal layers is the first layer, the heat generating layer 132 is the second layer, and the base layer 134 is the third layer as mentioned above, and that the resistances of the respective layers are Ra1, Ra2, Ra3, the total resistance Ra is the total resistance of the parallel-connected circuit of Ra1 through Ra3, and 1/Ra=1/Ra1+1/Ra2+1/Ra3. Therefore, (t×K)/(ρ×I)=(t1×K)/(ρ1×I)+(t2×K)/(ρ2×I)+(t3×K)/(ρ3×I).

If the I/K on the both sides are eliminated and R is expressed as a ratio of specific resistance and thickness as R=ρ/t, R1=ρ1/t1, R2=ρ2/t2 and R3=ρ3/t3, formula (6) is obtained.

$$1/R=(1/R_1+1/R_2+1/R_3) \qquad \text{formula (6)}$$

Here, the protective layer 130 and the base layer 134 are the same material and the same thickness, and $\rho 1=\rho 3=60\times10^{-8}$ [Ωm], and $t1=t3=30\times10^{-6}$ [m]. Therefore, Ra1=Ra3=ρ1×I/t1=$2\times10^{-2}$×I/K [Ω]. Further, when Ra2 of the heat generating layer 132 is determined similarly, Ra2=$1.7\times10^{-3}$×I/K [Ω].

Accordingly, by using formula (6), the total resistance R is $1.5\times10^{-3}$×I/K [Ω]. Because Ra, Ra1, Ra2 and Ra3 all have I and K in common, by eliminating the I and the K and making the ratio of the specific resistance value and the thickness be Rn=ρn/tn, R=$1.5\times10^{-3}$ [Ω/m].

Here, as described above, it is preferable that the thickness t2 of the heat generating layer 132 of the metal layers be less than or equal to 20 μm, and further, it is preferable that the specific resistance ρ2 thereof be less than or equal to $1.7\times10^{-8}$ Ωm. Therefore, the ratio R of the specific resistance value and the thickness, in which I/K is removed from the total resistance Ra of the respective metal layers, is preferably smaller than the maximum value of R2 in which I/K is removed from the resistance Ra2 of the heat generating layer 132. This is expressed in a formula as formula (7).

$$1/R=(2\times10^{-5}\,[\mathrm{m}]/1.7\times10^{-8}\,[\Omega\mathrm{m}])\leqq 1/R_1+1/R_2+1/R_3 \qquad \text{formula (7)}$$

At the metal layers of the fixing belt 102, the ratio of the specific resistance value, which is derived from the obtained total resistance, and the thickness is R=$1.5\times10^{-3}$ [Ω/m], and satisfies formula (7).

By limiting the ratio of the specific resistance value, which is derived from the total resistance R of the metal layers, and the thickness by using formula (7) in this way, it can be specified whether or not metal layers of a total thickness t can be appropriately heated on the whole.

Note that the metal layers are not only the above-described three-layer structure of the protective layer 130, the heat generating layer 132 and the base layer 134, and may be metal layers which include at least the heat generating layer 132 and the base layer 134 and are formed of n layers (n≧2). In this case, the conditional expression of the ratio of the specific resistance value, which is derived from the total resistance R, and the thickness is formula (8).

$$1/R=1.2\times10^{-3}\leqq 1/R_1+1/R_2+1/R_3+\ldots+1/R_n \qquad \text{formula (8)}$$

The layered position of the heat generating layer 132 in the fixing belt 102 will be explained next.

FIG. 3A models the layer structure of the fixing belt in cross-section, and shows a state in which n layers of i=1, 2, . . . , n are layered in order toward the inner peripheral side with the surface (the outer peripheral surface) of the fixing belt being the reference surface.

Given that the distance in the direction of thickness of the fixing belt is y, the cross-sectional area of the ith layer from the surface is Ai, and width of this layer is bi, and the elastic coefficient is Ei, a distance y0 from the surface of the fixing belt to the neutral axis is defined by formula (9).

$$y_0=\sum\left(E_i\int_{A_i} y\,dA_i\right)\Big/\sum E_iA_i \qquad \text{formula (9)}$$

Here, when considering the unit width (bi=b=1), then dAi=d(b×yi)=dyi, and the distance y0 from the surface of the fixing belt to the neutral axis is expressed by formula (10).

$$y_0 = \sum\left(E_i \int_{A_i} y d y_i\right) \Big/ \sum E_i y_i \qquad \text{formula (10)}$$

In the fixing belt 102 which is used in the present exemplary embodiment, when computing the distance y0 from a reference, which is the surface of the releasing layer 126 (y=0), to the neutral axis on the basis of formula (10) with the releasing layer 126 being 30 μm, the elastic layer 128 being 200 μm, the protecting layer 130 being 30 μm, the heat generating layer 132 being 10 μm, and the base layer 134 being 30 μm, y0=265 μm as shown in Table 2.

TABLE 2

| material | Young's modulus E [×10$^6$ N/m$^2$] | thickness yi (μm) = cross-sectional area per unit width | border (μm) with next material | formula of neutral plane: numerator Ei $\int_{Ai}$ydyi | formula of neutral plane: denominator EiAi | formula of neutral plane: neutral plane y0 |
|---|---|---|---|---|---|---|
| PFA | 588 | 30 | 30 | 264600 | 17640 | — |
| Si rubber | 0.45 | 200 | 230 | 11700 | 90 | — |
| SUS | 200000 | 30 | 260 | 1470000000 | 6000000 | — |
| Cu | 129447 | 10 | 270 | 343034550 | 1294470 | — |
| SUS | 200000 | 30 | 300 | 1710000000 | 6000000 | — |
| Total | — | — | — | 3523310850 | 13312200 | 265 |

Because the heat generating layer 132 is positioned at a distance of from 260 μm to 270 μm, the neutral axis (y0=265 μm) is positioned at the heat generating layer 132.

Here, as shown in Table 2, it can be understood that the thicknesses of the layers having a high Young's modulus affect the formula of the neutral plane and the position of the neutral plane. Namely, by adjusting the thicknesses of the base layer 134 and the protective layer 130, the heat generating layer 132 is positioned at the neutral plane. The base layer 134 and the protective layer 130 can also be called adjustment layers for adjusting the position of the heat generating layer 132.

Operation of the first exemplary embodiment will be described next.

As shown in FIG. 1, the recording sheet P, which has passed through the above-described image forming process of the printer 10 and on which toner has been transferred, is sent to the fixing device 100.

At the fixing device 100, due to the control of the control unit 50, the pressure-applying roller 104 is set apart from the surface of the fixing belt 102 until the time that the temperature of the surface of the fixing belt 102 reaches the set fixing temperature. When the temperature of the surface of the fixing belt 102 reaches the set fixing temperature, the pressure-applying roller 104 moves and contacts the surface of the fixing belt 102.

The temperature of the surface of the fixing belt 102 temporarily falls due to the contact with the pressure-applying roller 104, but, due to the heat generating layer 132 continuing to generate heat, the temperature of the surface of the fixing belt 102 reaches the set fixing temperature.

In this way, the temperature of the fixing belt 102 as a single unit can be raised without the pressure-applying roller 104 contacting the fixing belt 102 at the time of raising the temperature of the fixing belt 102. Therefore, the warm-up time can be shortened more than in a case in which the temperature is raised in a state in which the fixing belt 102 and the pressure-applying roller 104 contact one another.

Then, as shown in FIG. 2 and FIG. 3, at the fixing device 100, the pressure-applying roller 104 starts driving and rotating in the direction of arrow E, and the fixing belt 102 is thereby slave-rotated in the direction of arrow D. At this time, on the basis of the aforementioned electric signal from the control circuit 138, the energizing circuit 142 is driven and alternating current is supplied to the excitation coil 110.

When alternating current is supplied to the excitation coil 110, generation and extinction of the magnetic field H (see FIG. 2) as a magnetic circuit at the periphery of the excitation coil 110 are repeated.

Figure 5:
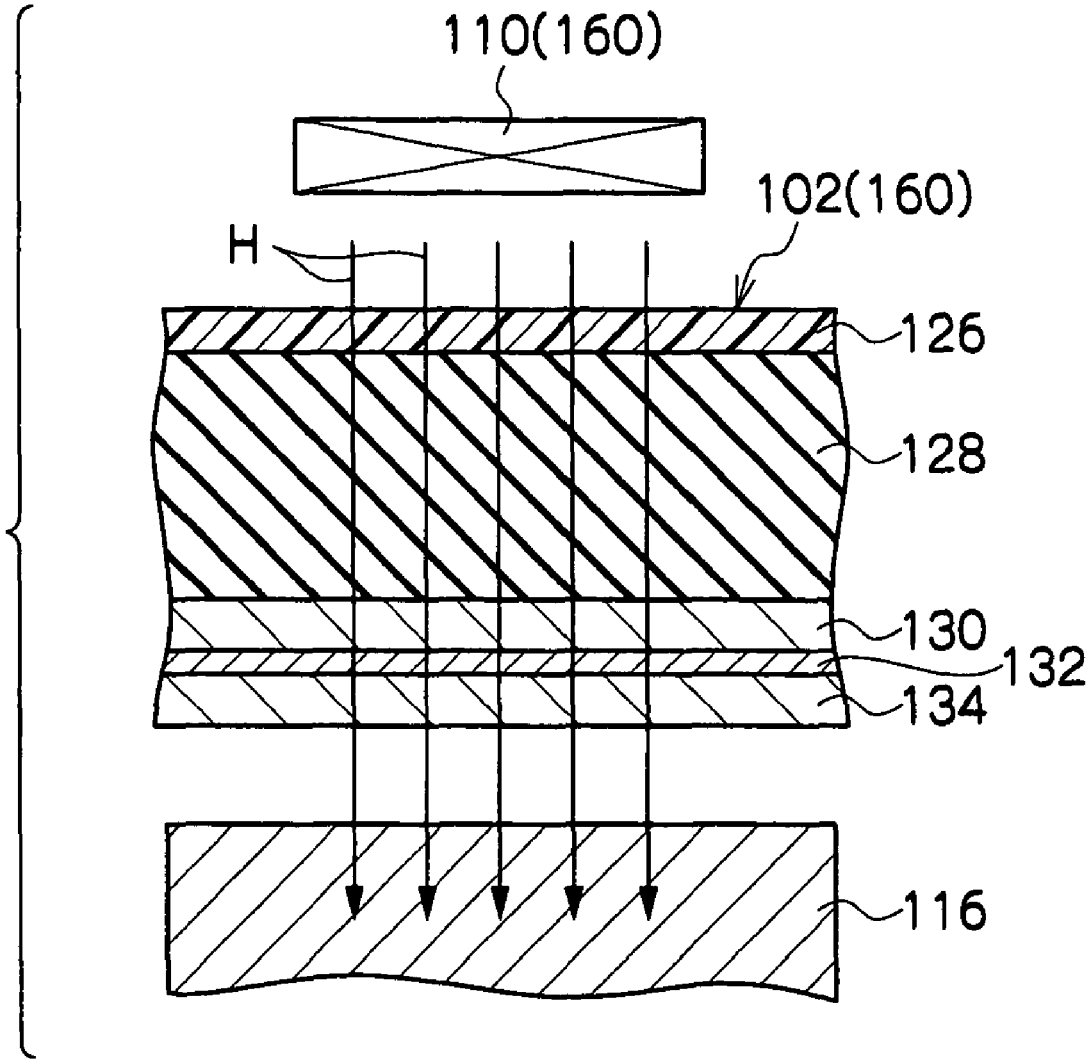
FIG. 5 is a schematic drawing showing a state in which a magnetic field passes through the fixing belt relating to the first exemplary embodiment.

Then, as shown in FIG. 5, when the magnetic field H traverses the heat generating layer 132 of the fixing belt 102, eddy current (not shown) is generated at the heat generating layer 132 such that a magnetic field which impedes changes in the magnetic field H arises.

The heat generating layer 132 generates heat in proportion to the magnitudes of the surface skin resistance of the heat generating layer 132 and the eddy current flowing through the heat generating layer 132, and the fixing belt 102 is thereby heated.

The temperature of the surface of the fixing belt 102 is sensed by the thermistor 120 as shown in FIG. 4. If the temperature has not reached the set fixing temperature 170° C., the control circuit 138 controls and drives the energizing circuit 142 such that alternating current of a predetermined frequency is passed to the excitation coil 110. Further, when the set fixing temperature is reached, the control circuit 138 stops the control of the energizing circuit 142.

Here, at the contact portion (the nip portion) of the fixing belt 102 and the pressure-applying roller 104, even if the fixing belt 102 curves and stress such as twisting force or the like is applied, because the heat generating layer 132 is positioned at the neutral axis of the fixing belt 102, the strain arising at the heat generating layer 132 can be kept low. Further, because the heat generating layer 132 is held by the base layer 134 which is a metal layer, the mechanical strength and rigidity are high as compared with a structure using a resin layer of polyimide or the like at the base layer 134 as was the case conventionally.

In this way, at the heat generating layer 132, it is difficult for damage such as cracks or the like which impede the flow of the eddy current to arise. The durability of the fixing belt 102 improves, and the heat generating state of the fixing belt 102 is maintained.

Further, the mechanical strength (resistance) with respect to twisting force of the fixing belt 102 is strong, and a gear (not shown) can be mounted to the end portion of the fixing belt 102 and the fixing belt 102 can be driven directly by a motor.

The thickness of the heat generating layer 132 is less than or equal to 20 μm which is thin, and it is difficult for the specific resistance thereof to decrease. Therefore, it is difficult for the amount of heat generated by the fixing belt 102 to decrease.

Further, the total of the thicknesses of the layers formed from the base layer 134, the heat generating layer 132 and the protective layer 130 is less than or equal to 200 μm, and it suffices to not use a metal pipe whose thickness is usually greater than or equal to 300 μm. Therefore, the fixing device 100 can be made to be compact.

The base layer 134 and the protective layer 130 are formed of non-magnetic stainless steel (specific resistance: 60 to $80\times10^{-8}$ Ωm) whose specific resistance is large as compared with that of the copper (specific resistance: $1.7\times10^{-8}$ Ωm) of the heat generating layer 132. Thus, hardly any eddy current flows at the base layer 134 and the protective layer 130, and it is difficult for these layers to generate heat. Therefore, the heat generation of the fixing belt 102 due to the heat generation of the heat generating layer 132 is not impeded by heat generation of the base layer 134 or the protective layer 130.

Because the fixing belt 102 is a seamless tube formed from clad steel, it is difficult for peeling to arise between the respective layers which are the base layer 134, the heat generating layer 132, and the protective layer 130. Thus, cracks do not form in the heat generating layer 132 and the temperature of the fixing belt 102 does not decrease, and non-uniform fixing of images does not occur.

Then, as shown in FIG. 2, the recording sheet P which has been sent-into the fixing device 100 is heated and pushed by the fixing belt 102, at which the heat generating layer 132 generates heat and which has become the predetermined set fixing temperature (170° C.), and the pressure-applying roller 104, and the toner image is fixed to the surface of the recording sheet P.

When the recording sheet P is sent-out from the nip portion between the fixing belt 102 and the pressure-applying roller 104, due to its own rigidity, it attempts to advance straight in the direction along the nip portion, and therefore is peeled away from the fixing belt 102.

The recording sheet P which is discharged-out from the fixing device 100 is discharged onto the tray 38 by the sheet conveying rollers 36.

A second exemplary embodiment of the heating device will be described next on the basis of the drawings.

Note that parts which are basically the same as those of the above-described first exemplary embodiment are denoted by the same reference numerals as in the first exemplary embodiment, and description thereof is omitted.

Figure 8:
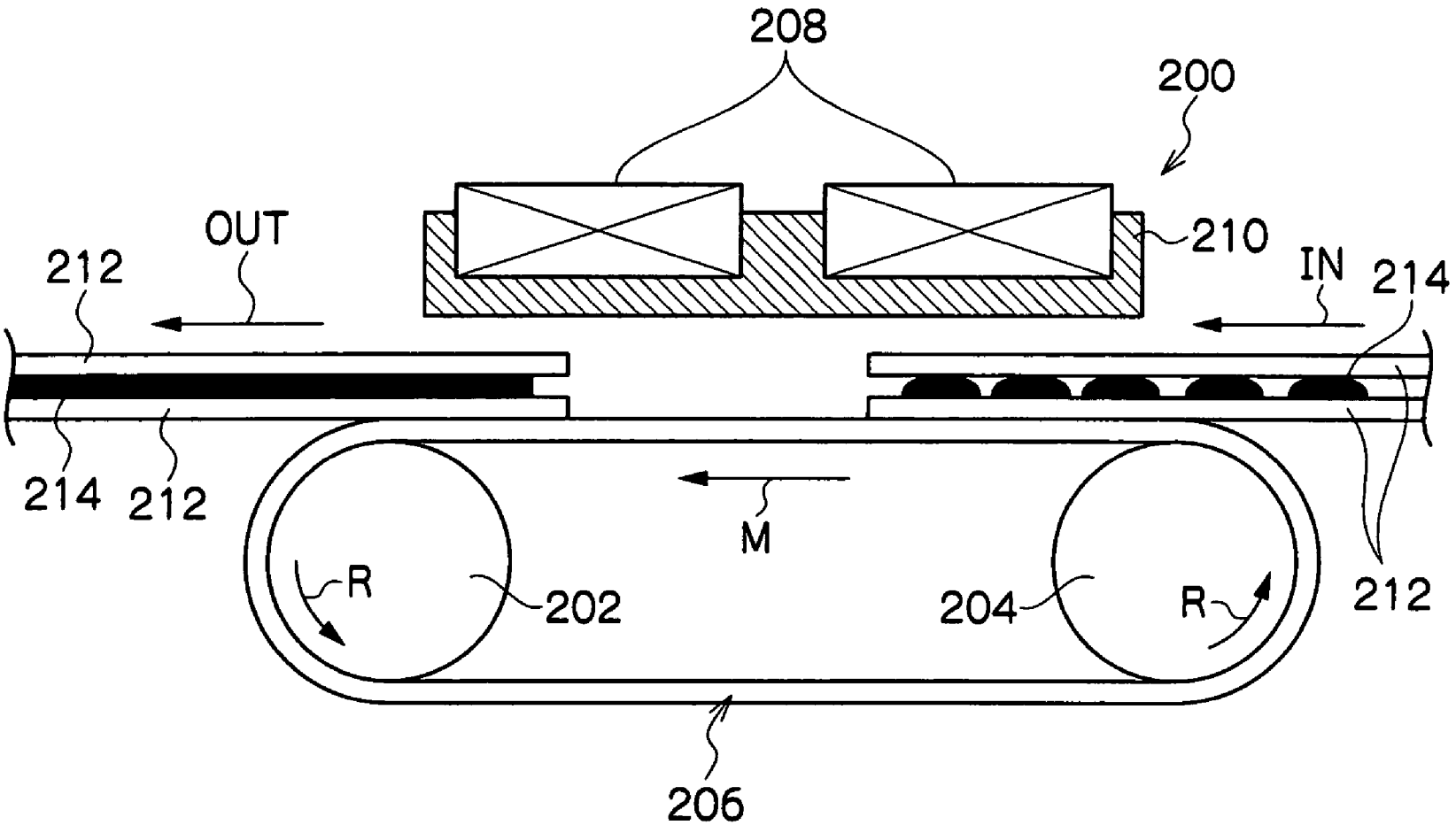
FIG. 8 is a cross-sectional view of a heating device relating to a second exemplary embodiment.

A heating device 200 is shown in FIG. 8.

The heating device 200 has an excitation coil 208, which is energized by an unillustrated energizing unit and generates a magnetic field, and a heating belt 206, which is disposed so as to oppose the excitation coil 208 and is formed of a material and a layer structure which are similar to those of the previously-described fixing belt 102 (see FIG. 2).

The excitation coil 208 is fixed by adhesion to and is supported by a bobbin 210 made of resin.

The heating belt 206 is stretched over a pair of rollers 202, 204 at which non-magnetic SUS is used as the core metal and a silicon rubber layer of a predetermined surface roughness (a surface roughness which is such that the rollers 202, 204 can move the heating belt 206) covers the surface of the core metal.

One of the rollers 202, 204 is connected to an unillustrated driving unit of gears, a motor, and the like, and rotates in the direction of arrow R. When the rollers 202, 204 rotate in the direction of arrow R, the heating belt 206 moves in the direction of arrow M.

Note that the heating belt 206 may be formed substantially in the shape of a cylindrical tube, and a gear may be adhered and fixed to an end portion thereof and the heating belt 206 directly driven thereby.

Operation of the second exemplary embodiment will be described next. Note that the present exemplary embodiment describes a case in which the heating device 200 is used in melt adhesion.

First, the excitation coil 208 is energized by the unillustrated energizing unit, and generates a magnetic field at the periphery of the excitation coil 208. In the same way as the previously-described fixing belt 102, the heating belt 206 generates heat due to the working of electromagnetic induction caused by this magnetic field.

Next, the rollers 202, 204 are driven and rotate, and the heating belt 206 starts to move in the direction of arrow M. In this way, a pair of resin plates 212 is conveyed to the heating device 200 (arrow IN). Here, an adhesive 214 which is formed of a solid resin which fuses at a predetermined temperature is sandwiched between the pair of plates 212.

Then, the adhesive 214 is fused due to the heat generation of the heating belt 206, and spreads between the pair of plates 212. Due to the movement of the heating belt 206, the plates 212 are sent-out from the heating device 200 (arrow OUT).

The pair of plates 212 which are sent-out from the heating device 200 are adhered due to the cooling and solidifying of the adhesive 214 which had fused and spread.

Note that the present invention is not limited to the above-described exemplary embodiments.

The printer 10 is not limited to a dry electrophotographic method using solid developers, and may be a printer which uses liquid developers.

As the method of sensing the temperature of the fixing belt 102, a thermocouple may be used instead of the thermistor 120.

The position at which the thermistor 120 is mounted is not limited to the surface of the fixing belt 102, and the thermistor 120 may be mounted at the inner peripheral surface of the fixing belt 102. In this case, it is difficult for the surface of the fixing belt 102 to become worn. Further, the thermistor 120 may be mounted to the surface of the pressure-applying roller 104.

Other than melt adhesion, the heating device 200 may be used as a drying device.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a magnetic field generating unit that generates a magnetic field; and a heating/rotating unit disposed so as to oppose the magnetic field generating unit, and having n (n≧2) metal layers which satisfy the following conditions (a), (b), (c) and include at least a heat generating layer, which is electromagnetically induced by the magnetic field to generate heat, and a supporting layer which supports the heat generating layer, wherein the magnetic field generating unit includes a first magnetic core and a second magnetic core such that the first magnetic core is arranged inside the heating/rotating unit and the second magnetic core is arranged outside the heating/rotating unit:

(a) a total thickness t of the metal layers is greater than or equal to 30 μm and less than or equal to 200 μm;

(b) the following formula (1) and formula (2) are satisfied:

$$\text{the total thickness } t \text{ of metal layers} < (\delta 1+\delta 2+\delta 3+\ldots+\delta n) \quad \text{formula (1)}$$

$$\text{thickness tn of nth metal layer} < \delta n \quad \text{formula (2)}$$

where δ is a surface skin depth of metal, surface skin depths δ1, δ2, δ3, . . . , δn of a first layer, a second layer, a third layer, . . . , an nth layer are $\delta 1=503\sqrt{(\rho 1/f\times\mu 1)}$, $\delta 2=503\sqrt{(\rho 2/f\times\mu 2)}$, $\delta 3=503\sqrt{(\rho 3/f\times\mu 3)}$, $\delta n=503\sqrt{(\rho n/f\times\mu n)}$, ρn is a specific resistance of each metal layer, f is a frequency of a signal at the magnetic field generating unit, and μn is a relative permeability at room temperature of each metal layer; and (c) the following formula (3) is satisfied:

$$1/R \leqq (1/R1+1/R2+1/R3+\ldots+1/Rn) \quad \text{formula (3)}$$

where R is expressed as a ratio of specific resistance value to thickness as R=ρ/t, R1=ρ1/t1, R2=ρ2/t2, R3=ρ3/t3, and Rn=ρn/tn, wherein the metal layers include a protective layer which protects the heat generating layer, and wherein the supporting layer and the protective layer are formed of a metal which is different than the heat generating layer, and all of the metal layers are non-magnetic metals and used as non-magnetic materials.

2. The heating device of claim 1, wherein the heat generating layer is a non-magnetic body of a thickness of greater than or equal to 2 μm and less than or equal to 20 μm.

3. The heating device of claim 1, wherein a neutral axis of the heating/rotating unit is positioned in the heat generating layer.

4. The heating device of claim 2, wherein a neutral axis of the heating/rotating unit is positioned in the heat generating layer.

5. The heating device of claim 2, wherein the metal layers include the protective layer which protects the heat generating layer.

6. The heating device of claim 5, wherein the supporting layer and the protective layer are formed of a metal which is different than the heat generating layer, and all of the metal layers are non-magnetic metals.

7. The heating device of claim 1, wherein the metal layers are formed by a seamless tube manufactured from clad steel.

8. A fixing device comprising:

a magnetic field generating unit that generates a magnetic field;

a heating/rotating unit disposed so as to oppose the magnetic field generating unit, and having n (n≧2) metal layers which satisfy the following conditions (a), (b), (c) and include at least a heat generating layer, which is electromagnetically induced by the magnetic field to generate heat, and a supporting layer which supports the heat generating layer, wherein the magnetic field generating unit includes a first magnetic core and a second magnetic core such that the first magnetic core is arranged inside the heating/rotating unit and the second magnetic core is arranged outside the heating/rotating unit;

a supporting body disposed at an inner side of the heating/rotating unit; and a pressure-applying/rotating body which applies pressure to the supporting body via the heating/rotating unit:

(a) a total thickness t of the metal layers is greater than or equal to 30 μm and less than or equal to 200 μm;

(b) the following formula (1) and formula (2) are satisfied:

$$\text{the total thickness } t \text{ of metal layers} < (\delta 1+\delta 2+\delta 3+\ldots+\delta n) \quad \text{formula (1)}$$

$$\text{thickness tn of nth metal layer} < \delta n \quad \text{formula (2)}$$

where δ is a surface skin depth of metal, surface skin depths δ1, δ2, δ3, . . . , δn of a first layer, a second layer, a third layer, . . . , an nth layer are $\delta 1=503\sqrt{(\rho 1/f\times\mu 1)}$, $\delta 2=503\sqrt{(\rho 2/f\times\mu 2)}$, $\delta 3=503\sqrt{(\rho 3/f\times\mu 3)}$, $\delta n=503\sqrt{(\rho n/f\times\mu n)}$, ρn is a specific resistance of each metal layer, f is a frequency of a signal at the magnetic field generating unit, and n is a relative permeability at room temperature of each metal layer; and (c) the following formula (3) is satisfied:

$$1/R \leqq (1/R1+1/R2+1/R3+\ldots+1/Rn) \quad \text{formula (3)}$$

where R is expressed as a ratio of specific resistance value and thickness as R=ρ/t, R1=ρ1/t1, R2=ρ2/t2, R3=ρ3/t3, and Rn=ρn/tn, wherein the metal layers include a protective layer which protects the heat generating layer, and wherein the supporting layer and the protective layer are formed of a metal which is different than the heat generating layer, and all of the metal layers are non-magnetic metals and used as non-magnetic materials.

9. The fixing device of claim 8, further comprising a magnetic unit disposed so as to oppose the magnetic field generating unit via the heating/rotating unit, and collecting magnetic flux of the magnetic field generated at the magnetic field generating unit.

10. The fixing device of claim 8, wherein, at a contact portion of the pressure-applying/rotating body and the heating/rotating unit, a concave portion is formed at the heating/rotating unit and convex portions are formed at both sides of the concave portion.

11. The fixing device of claim 9, wherein, at a contact portion of the pressure-applying/rotating body and the heating/rotating unit, a concave portion is formed at the heating/rotating unit and convex portions are formed at both sides of the concave portion.

12. An image forming device comprising:

an exposure unit that emits exposure light;

a developing unit that makes a latent image, which is formed by the exposure light of the exposure section, visible by a developer, and forms a developer image;

a transfer unit that transfers, onto a recording medium, the developer image made visible at the developing unit;

a conveying unit that conveys the recording medium onto which the developer image has been transferred at the transfer unit;

a magnetic field generating unit that generates a magnetic field;

a heating/rotating unit disposed so as to oppose the magnetic field generating unit and having n ($n \geqq 2$) metal layers which satisfy the following conditions (a), (b), (c) and include at least a heat generating layer, which is electromagnetically induced by the magnetic field to generate heat, and a supporting layer which supports the heat generating layer, wherein the magnetic field generating unit includes a first magnetic core and a second magnetic core such that the first magnetic core is arranged inside the heating/rotating unit and the second magnetic core is arranged outside the heating/rotating unit;

a supporting body disposed at an inner side of the heating/rotating unit; and a pressure-applying/rotating body which applies pressure to the supporting body via the heating/rotating unit:

(a) a total thickness t of the metal layers is greater than or equal to 30 μm and less than or equal to 200 μm;

(b) the following formula (1) and formula (2) are satisfied:

$$\text{the total thickness } t \text{ of metal layers} < (\delta 1 + \delta 2 + \delta 3 + \ldots + \delta n) \quad \text{formula (1)}$$

$$\text{thickness } tn \text{ of nth metal layer} < \delta n \quad \text{formula (2)}$$

where δ is a surface skin depth of metal, surface skin depths $\delta 1$, $\delta 2$, $\delta 3$, . . . , δn of a first layer, a second layer, a third layer, . . . , an nth layer are $\delta 1 = 503\sqrt{(\rho 1/f \times \mu 1)}$, $\delta 2 = 503\sqrt{(\rho 2/f \times \mu 2)}$, $\delta 3 = 503\sqrt{(\rho 3/f \times \mu 3)}$, $\delta n = 503\sqrt{(\rho n/f \times \mu n)}$, ρn is a specific resistance of each metal layer, f is a frequency of a signal at the magnetic field generating unit, and μn is a relative permeability at room temperature of each metal layer; and (c) the following formula (3) is satisfied:

$$1/R \leqq (1/R1 + 1/R2 + 1/R3 + \ldots + 1/Rn) \quad \text{formula (3)}$$

where R is expressed as a ratio of specific resistance value to thickness as $R = \rho/t$, $R1 = \rho 1/t1$, $R2 = \rho 2/t2$, $R3 = \rho 3/t3$, and $Rn = \rho n/tn$, wherein the metal layers include a protective layer which protects the heat generating layer, and wherein the supporting layer and the protective layer are formed of a metal which is different than the heat generating layer, and all of the metal layers are non-magnetic metals and used as non-magnetic materials.

* * * * *